US007328561B2

(12) United States Patent
Fochler

(10) Patent No.: US 7,328,561 B2
(45) Date of Patent: Feb. 12, 2008

(54) APPARATUS FOR ERECTING BOXES AND SETTING THEM ON A CONVEYOR

(75) Inventor: Fritz Fochler, Illerkirchberg (DE)

(73) Assignee: Uhlmann Pac-Systeme GmbH & Co. KG, Laupheim (DE)

( * ) Notice: Subject to any disclaimer, the term of this patent is extended or adjusted under 35 U.S.C. 154(b) by 0 days.

(21) Appl. No.: 11/406,518

(22) Filed: Apr. 18, 2006

(65) Prior Publication Data

US 2006/0240962 A1 Oct. 26, 2006

(30) Foreign Application Priority Data

Apr. 20, 2005 (DE) ..... 10 2005 018 391

(51) Int. Cl.
*B31B 1/78* (2006.01)
*B65B 43/18* (2006.01)

(52) U.S. Cl. ..... 53/564; 493/313; 493/315; 493/318; 53/458

(58) Field of Classification Search ..... 493/51, 493/122, 123, 309, 313, 315, 317, 318; 53/458, 53/564, 566, 309, 313, 315–317
See application file for complete search history.

(56) References Cited

U.S. PATENT DOCUMENTS 4,530,686 A 7/1985 Everson
4,596,545 A * 6/1986 Greenwell ..... 493/315
5,562,581 A * 10/1996 Roberto et al. ..... 493/310
5,603,599 A * 2/1997 Wesslen et al. ..... 414/411
5,653,671 A * 8/1997 Reuteler ..... 493/313
5,662,577 A * 9/1997 Reuteler ..... 493/315
5,997,458 A * 12/1999 Guttinger et al. ..... 493/315
6,383,123 B1 * 5/2002 Ehring et al. ..... 493/315
6,503,180 B1 * 1/2003 Pluschow et al. ..... 493/51
6,942,086 B2 * 9/2005 Bridges et al. ..... 198/377.08
7,163,502 B2 * 1/2007 Fulkerson et al. ..... 493/51

FOREIGN PATENT DOCUMENTS

EP 0 580 958 2/1994

* cited by examiner

*Primary Examiner*—Hemant M. Desai
(74) *Attorney, Agent, or Firm*—Andrew Wilford

(57) ABSTRACT

A sun wheel is centered on a sun axis between a magazine and a conveyor, a planet carrier is rotatable about the sun axis and defines a planet axis generally parallel to but offset from the sun axis, and a gripper shaft is journaled in the planet carrier at the planet axis and carries a gripper. A planet wheel carried on the gripper shaft is coupled by a toothed belt with the sun wheel. A first drive rotates the planet carrier about the sun axis and thereby rotates the gripper about the first planet axis to move the gripper through a hypocycloidal path past the magazine and the conveyor. An erecting shaft pivotal on the planet carrier carries an erecting element, and a second drive rotates the erecting shaft and its erecting element and unfolds a flattened box blank held by the gripper.

8 Claims, 3 Drawing Sheets

APPARATUS FOR ERECTING BOXES AND SETTING THEM ON A CONVEYOR

FIELD OF THE INVENTION

The present invention relates to an apparatus for erecting boxes and setting them on a conveyor. More particularly this invention concerns such an apparatus that pulls flattened box blanks out of a magazine holding a stack of the flattened blanks, erects the box, and sets it in a cell of a continuously moving conveyor.

BACKGROUND OF THE INVENTION

The invention relates to an apparatus for removing, transporting, erecting and inserting folding boxes from a magazine containing flatly folded boxes into a conveyor with conveyor cells for receiving one erected folding box. The apparatus has a planet carrier rotatably driven about a sun axis a planet shaft mounted pivotable about a planet axis eccentric to the sun axis and parallel to it at the planet shaft and a gripper with a head that holds the folding box as well as a planet wheel coaxial with the planet axis and coupled to a sun wheel fixed coaxially on the sun axis. The planet wheel and the sun wheel form a transmission for rotating the planet shaft on the planet carrier when the planet carrier is turned so that the gripper revolves on a closed hypocycloidal trajectory with several cusp points. A erecting element rotatably mounted on the planet shaft and abuts the folding box with a pusher as well as a driving device to erect the box as the system rotates.

Such device is known from the EP 0 580 958 of Fochler, and has proven itself in practice, but is fairly complex and expensive because of the complex mechanism used to operate the erecting tool. This mechanism is made up of various gears and levers coupled to the planet-carrier drive and is extremely difficult to set to work on boxes of different dimensions. What is more the entire drive assembly of the various part is very complex and expensive, and must be produced to very high precision.

OBJECTS OF THE INVENTION

It is therefore an object of the present invention to provide an improved apparatus for unfolding and erecting flattened box blanks and inserting them in passing conveyor cells.

Another object is the provision of such an improved apparatus for unfolding and erecting flattened box blanks and inserting them in passing conveyor cells that overcomes the above-given disadvantages, in particular that is readily adapted to boxes of different sizes.

SUMMARY OF THE INVENTION

A box-erecting and loading apparatus has according to the invention a first nonrotating sun wheel centered on a sun axis between the magazine and the conveyor, a planet carrier rotatable about the sun axis and defining a first planet axis generally parallel to but offset from the sun axis, and a gripper shaft journaled in the planet carrier at the first planet axis. A gripper extends radially of the first planet axis from the gripper shaft. A first planet wheel carried on the gripper shaft is coupled by a first toothed belt with the first sun wheel. A first drive rotates the planet carrier about the sun axis and thereby orbits the first planet axis about the sun axis and rotates the gripper shaft with its gripper about the first planet axis. The effective diameters of the first wheels are such that on one revolution of the planet carrier about the sun axis the gripper moves through a hypocycloidal path having nodes at a magazine holding flattened boxes and at a passing conveyor. An erecting shaft pivotal on the planet carrier about a second planet axis carries an erecting element extending radially of the second planet axis from the erecting shaft. A second drive independent of the first drive rotates the erecting shaft and its erecting element about the second planet axis and unfolds a flattened box blank held by the gripper.

Thus according to the invention uses a belt transmission that is simple and that operates very quietly. A wholly separate drive is provided for the erecting tool so that it can be readily set for boxes of different format. As a result there is a reduction of the variety of pieces due to reduction of the specially adapted cams and in particular drive parts for the erecting tool which needs to be reset to the size of the folding box to a large extent independently from the position of the box gripper. The beginning of the opening operation can be freely selected within a predetermined time-frame, and also the overbreak angle in opening the folding box can be freely selected to satisfy different types of folding boxes and their size.

The adjustment of the erecting tool which is free to a large extent is achieved by the fact that, when there is more than one gripper with an erecting tool, the tools can be individually controlled. This is best done by driving them through axially offset toothed belts, making independent control from, for example, a servomotor relatively easy.

For a spatial equalization of the structural components the erector sun wheel is attached to a hollow shaft extending coaxially to the sun axis and coupled to a drive shaft that in turn is coupled via a respective toothed belt to the hollow shaft and to its own drive.

BRIEF DESCRIPTION OF THE DRAWING

The above and other objects, features, and advantages will become more readily apparent from the following description, reference being made to the accompanying drawing in which.

SPECIFIC DESCRIPTION

Figure 1:
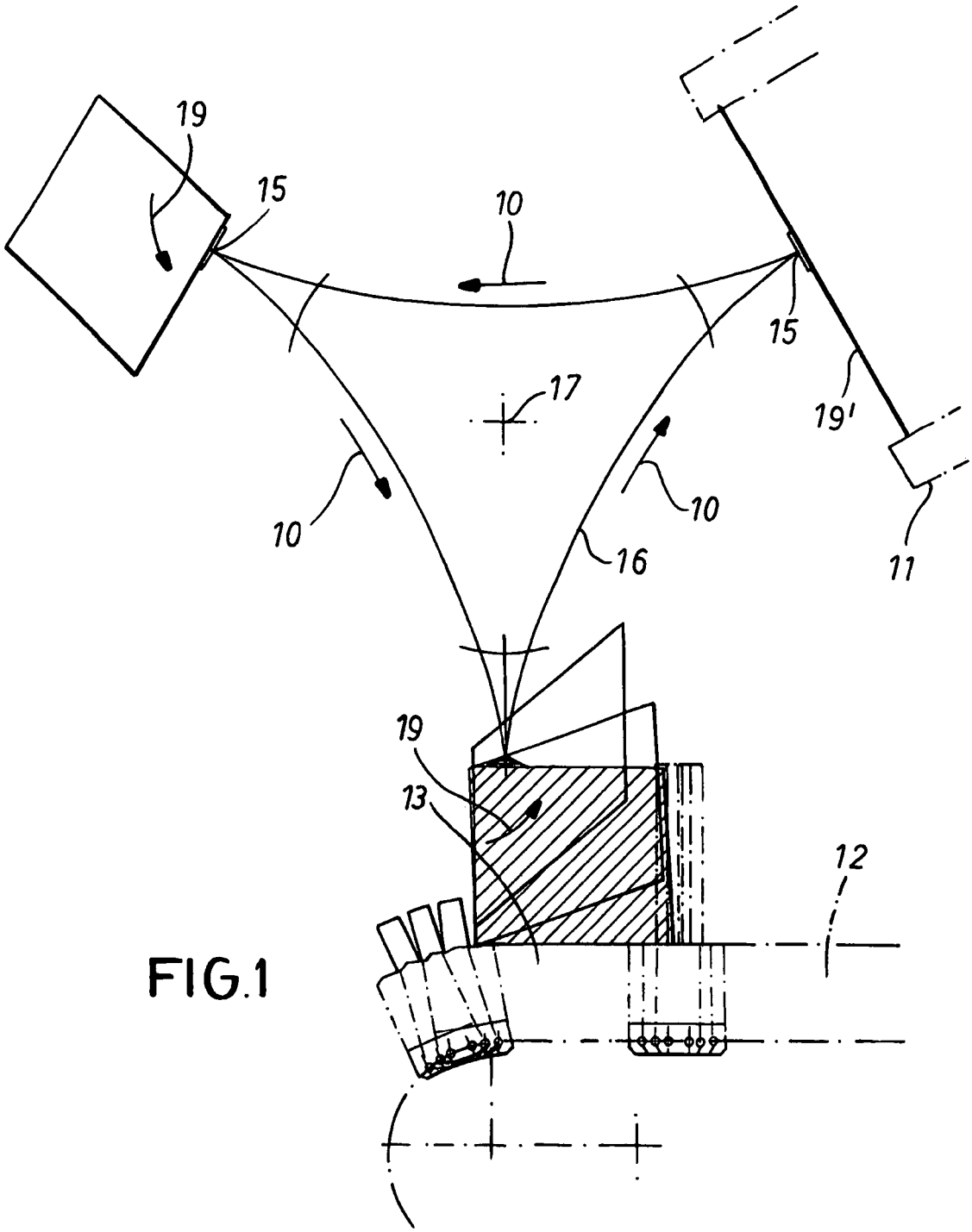
FIG. 1 is a schematic end view illustrating the system of this invention.

FIG. 1 shows an apparatus for removing, transporting, erecting and inserting boxes 19 from a magazine 11 containing a stack of flatly folded folding box blanks 19' into a conveyor 12 with conveyor cells 13 that each receive a respective one of the boxes 19, only one of which is shown in FIG. 1. The transfer of the folding boxes 19 is carried out by means of a gripper 14 that moves along a hypocycloidal path 16 between the magazine 11 and the conveyor 12 in a direction of arrows 10 with three nodes or cusp points 15, the right upper cusp point 15 being at the magazine 11 and the lower cusp point 15 being at the conveyor 12.

Figure 2:
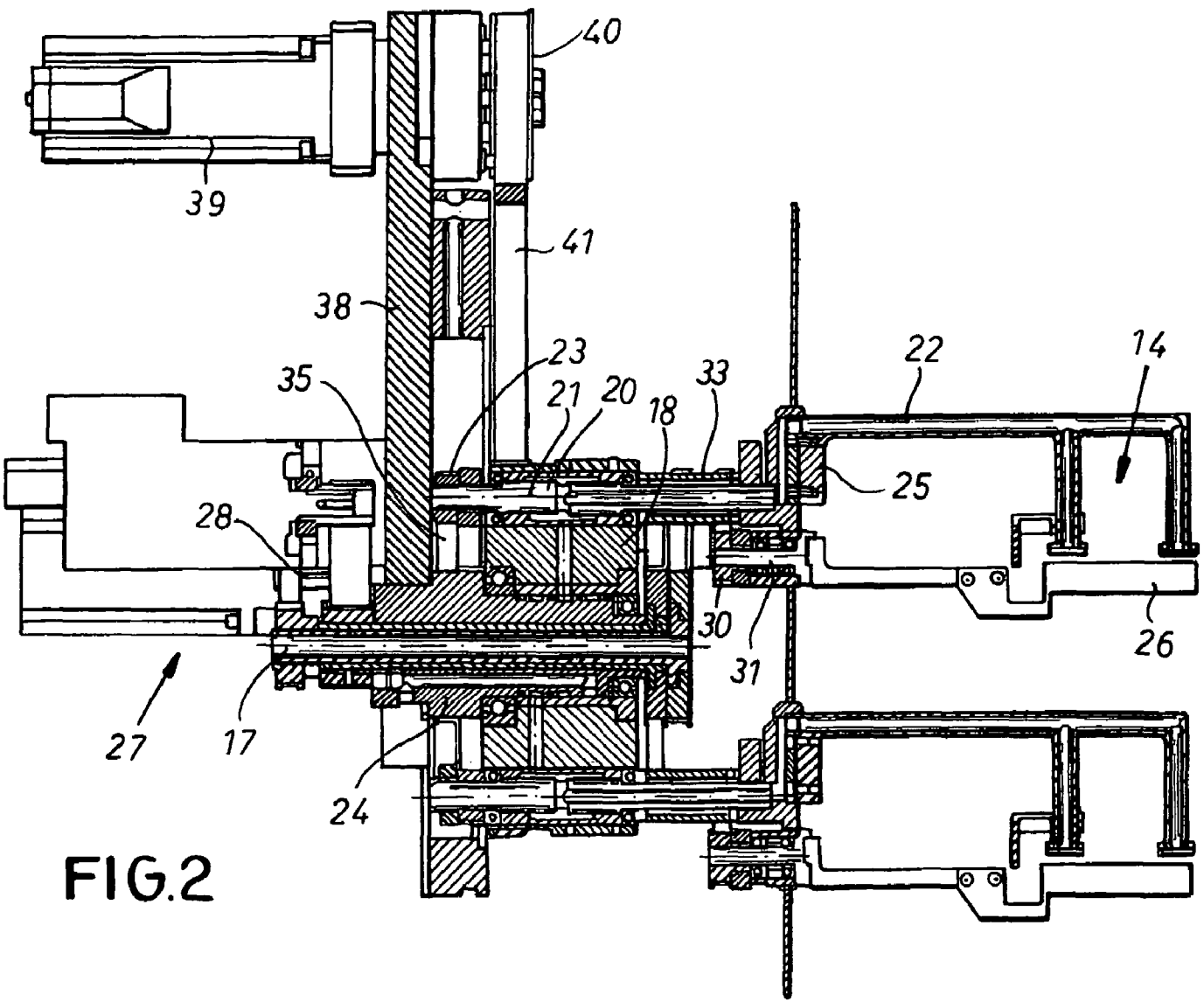
FIG. 2 is a small-scale axial section through the box-erecting and -loading apparatus of this invention.
Figure 3:
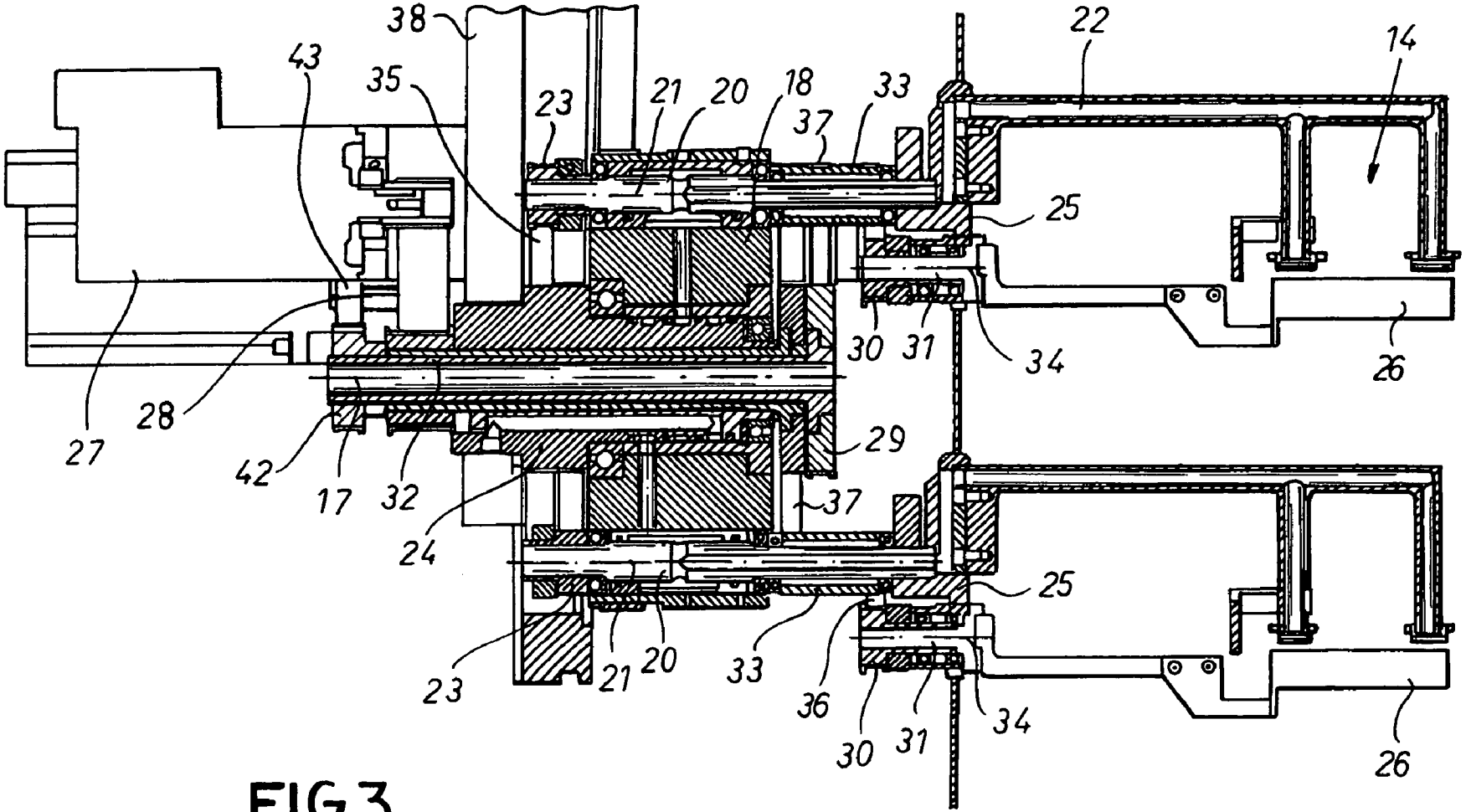
FIG. 3 is a large-scale view of the lower region of FIG. 2.

The apparatus shown in more detail in FIGS. 2 and 3 has a stationary support 38 on which is fixed a pair of axially adjacent first nonrotating sun wheels 24 centered on a sun axis. 17 between the magazine 11 and the conveyor 12. A planet carrier 18 rotatable about the sun axis 17 defines a pair of diametrally offset planet axes 21 generally parallel to but offset from the sun axis 17. A respective gripper shaft 20 is journaled in the planet carrier 18 at each of the planet axes 21 and each have an outer end 25 carrying an arm 22 in turn carrying a respective one of the grippers 14, which themselves extend radially of each planet axis 21 from the respective gripper shaft 20.

A first planet wheel 23 is carried on an inner end of each gripper shaft 20 and a first toothed belt 35 is engaged between each first sun wheel 24 and a respective one of the first planet wheel 23. A first drive comprised of a motor 39 fixed on the frame 38, a drive wheel 40 rotated by the motor 39, and a toothed belt 41 engaged between the wheel 40 and the planet carrier 18 rotates the planet carrier 18 about the sun axis 17 and thereby orbits the planet axes 21 about the sun axis 17 and rotates the gripper shafts 20 with their grippers 14 about the planet axes 21. The effective diameters of the wheels 23 and 24 is such that on one rotation of the planet carrier 18 about the sun axis 17 the grippers 14 moves through the hypocycloidal path 16 having the nodes 15 at the magazine 11 and at the conveyor 12.

In addition a tubular erecting shaft 31 is pivotal on the outer end 25 of each of the gripper shafts 20 about a respective second planet axis 34 adjacent the respective first planet axis 21. An erecting element 26 extends from each such erecting shaft 31. A second drive serves to rotate these erecting elements 26 independently of the respective grippers 14. This second drive includes a tubular shaft 33 journaled on the respective shaft 20 and connected at an outer end via a belt 36 to a wheel 30 on an inner end of the respective shaft 31 and a belt 37 connecting it to a respective second sun gear 29 connected through a respective tubular shaft 32 extending along the axis 17 to an inner wheel 42 connected by a belt 43 to a shaft 28 of servomotor 27. In this manner these erectors 26 can move so as to open up the blanks 19' as shown on the upper left of FIG. 1 into three-dimensional boxes 19 that can be set in the cells 13.

The prehensile head 14 is formed by suction cups connected in an unillustrated manner to a pump so they can adhere to and hold the box blanks 19', and can release them when they are aligned in the cells 13. Thus the pressure in the suction cups is dependent on the angular position, being below atmospheric pressure except when in the node 15 at the cell 13.

I claim:

1. In combination with a magazine holding a stack of flattened box blanks and a conveyor continuously displacing a row of cells adjacent the magazine, a box-erecting and loading apparatus comprising:

a first nonrotating sun wheel centered on a sun axis between the magazine and the conveyor;

a planet carrier rotatable about the sun axis and defining a first planet axis generally parallel to but offset from the sun axis;

a gripper shaft journaled in the planet carrier at the first planet axis;

a gripper extending radially of the first planet axis from the gripper shaft;

a first planet wheel carried on the gripper shaft;

a first toothed belt engaged with the first sun wheel and with the first planet wheel;

first drive means for rotating the planet carrier about the sun axis and thereby orbiting the first planet axis about the sun axis and rotating the gripper shaft with its gripper about the first planet axis, the effective diameters of the first wheels being such that on one revolution of the planet carrier about the sun axis the gripper moves through a hypocycloidal path having nodes at the magazine and at the conveyor;

an erecting shaft pivotal on the planet carrier about a second planet axis;

an erecting element extending radially of the second planet axis from the erecting shaft; and second drive means independent of the first drive means for rotating the erecting shaft and its erecting element about the second planet axis and unfolding a flattened box blank held by the gripper.

2. The apparatus defined in claim 1 wherein the second drive means includes a second planet wheel carried on the erecting shaft;

a second sun wheel centered on the sun axis; and a second toothed belt engaged between the second wheels.

3. The apparatus defined in claim 2 wherein the first and second planet axes are parallel to but offset from each other.

4. The apparatus defined in claim 2 wherein angularly equispaced about the sun axis there are a plurality of the erecting shafts with respective erecting elements, second planet wheels, and second belts connected to respective second sun wheels, the sun wheels and second belts being axially offset from one another.

5. The apparatus defined in claim 2 wherein the second drive means further comprises a second sun shaft extending through the planet carrier and having an outer end carrying the second sun wheel and an inner end; and a drive motor connected to the second-shaft inner end.

6. The apparatus defined in claim 5 wherein the second drive means further comprises another second toothed belt connecting the drive motor to the second-shaft inner end.

7. The apparatus defined in claim 1 wherein angularly equispaced about the sun axis there are a plurality of the gripper shafts with respective grippers, first planet wheels, and first belts, the first belts being axially offset from one another.

8. The apparatus defined in claim 1 wherein the first drive means includes a first drive motor; and a toothed belt connecting the first drive motor with the planet carrier.

* * * * *